United States Patent [19]

Ruff

[11] 3,938,695

[45] Feb. 17, 1976

[54] DRINK-THROUGH SLOSH-INHIBITING CLOSURE LIDS FOR POTABLE OPEN-TOP CONTAINERS

[76] Inventor: Stanley Ruff, 9 Arbor Drive, New Rochelle, N.Y. 10804

[22] Filed: Jan. 18, 1974

[21] Appl. No.: 434,649

[52] U.S. Cl. ..... 220/90.4; 220/DIG. 30; 222/527; 222/565; 229/7 R; 229/43

[51] Int. Cl.[2] ..... F47G 19/22

[58] Field of Search ..... 220/90.2, 90.4, 90.6, 1 BC, 220/60 R, 44 R, DIG. 30, 260; 222/527, 566, 570, 575, 565, 480; 229/43, 7 R

[56] References Cited

UNITED STATES PATENTS

| | | | |
|---|---|---|---|
| 2,106,453 | 1/1938 | Ekdahl | 220/90.4 |
| 2,119,502 | 5/1938 | Bertels | 220/1 BC |
| 2,534,614 | 12/1950 | Michael | 220/90.4 |
| 2,765,639 | 10/1956 | Bryant | 220/90.4 |
| 2,964,047 | 12/1960 | Jackson et al. | 229/7 R |
| 3,003,668 | 10/1961 | Sherlock et al. | 220/27 |
| 3,018,024 | 1/1962 | Foord | 229/7 R |
| 3,034,680 | 5/1962 | Steinberg | 220/29 |
| 3,093,273 | 6/1963 | Borah | 222/527 |
| 3,184,126 | 5/1965 | Casull | 220/90.2 |
| 3,204,805 | 9/1965 | May | 220/90.2 |
| 3,281,009 | 10/1966 | Collie et al. | 220/90.6 |
| 3,292,828 | 12/1966 | Stuart | 220/260 |
| 3,302,818 | 2/1967 | Balocca et al. | 229/7 R |
| 3,317,087 | 5/1967 | Landis | 222/480 |
| 3,654,064 | 4/1972 | Laumann | 220/DIG. 30 |
| 3,695,989 | 10/1972 | Albert | 220/DIG. 30 |
| 3,727,808 | 4/1973 | Fitzgerald | 220/90.4 |
| 3,730,399 | 5/1973 | Dibrell et al. | 220/90.4 |
| 3,762,454 | 10/1973 | Wilkins, Jr. | 220/DIG. 30 |
| 3,797,696 | 3/1974 | Dibrell | 220/90.4 |
| 3,868,043 | 2/1975 | Freemyer | 220/90.4 |

*Primary Examiner*—George E. Lowrance
*Assistant Examiner*—Allan N. Shoap
*Attorney, Agent, or Firm*—Kirschstein, Kirschstein, Ottinger & Frank

[57] ABSTRACT

A closure lid for capping the open top of a container. The container is of a type adapted to receive a potable liquid, usually one which is dispensed within a relatively close distance of the point at which it will be imbibed. Such containers with the closure lids emplaced thereon are used for "carry-out" services, as from a luncheonette, or for "carry-about" services, as from an on-the-premises beverage source such as a coffee brewer, a milk container, a carbonated or non-carbonated liquid vessel or a supply of hot water for tea or chocolate. It is customary to cap such containers with closure lids for carry-out purposes and to remove the lids when the potable is to be consumed; indeed it is quite usual to supply lids with the containers — although not attached — when the containers are sold to carry-out stores and to on-the-premises facilities where there are a large number of persons. The present invention provides a unique closure lid which when once in place is not intended to be removed but which is of such construction that a person can drink a potable through it from the capped container without experiencing any inconvenience and is such that it will minimize, and, indeed, almost eliminate, accidental spilling of the potable that heretofore has occurred when an uncapped container is jogged, shaken, or moved unevenly so as to cause spillage of its contents when a slosh wave overrides the rim of the container.

7 Claims, 17 Drawing Figures

DRINK-THROUGH SLOSH-INHIBITING CLOSURE LIDS FOR POTABLE OPEN-TOP CONTAINERS

BACKGROUND OF THE INVENTION

1. Field of the Invention

A closure lid for an open-top potable container. The closure lid, although removeably secureable to the container top, is designed and intended to be left permanently in place when once mounted on the container and is disposable with the used container. The lid is so constructed that a potable in the container can readily be drunk through the lid and, moreover, the lid preferably is structured in a manner such that slosh waves that may be induced in the potable are appreciably reduced in height to a degree that the potable will not tend to spill over the container rim accidentally upon irregular or sudden movement of the container.

2. Description of the Prior Art

Open top containers from which potables are drunk are ubiquitous items. Since they frequently are employed to carry beverages from a place of dispensal to a place of consumption and since, when carried about or even when moved in the area of consumption, e.g. aboard common carriers such as planes, buses and railroad cars, they are subject to sudden movement which may cause some of the beverage to slosh out of the containers, it is common to furnish containers with a supply of lids that are utilized to close the containers. The lids most usually employed are imperforate and must be removed to allow the beverage to be drunk. Some lids are formed with a single tiny opening, usually centrally located, to act as a vent. Other lids are formed with cruciform slits or an incomplete annular slit; both of these are designed to permit insertion of a drinking straw. However, lids that are removed for drinking cannot prevent escape of the beverage by sloshing and lids that are used with straws need straws to be supplied and, moreover, do not provide the user with the kind of oral satisfaction to which he has become accustomed through long usage by virtue of drinking over the rim of a cup or the like and do not provide the added satisfaction of inhaling the aroma of the beverage which is an ingrained secondary concomittant of drinking a fragrant beverage.

Also in the prior art are containers, such as cans, with permanently affixed tops, some of which are provided with pull tabs that when removed leave a small opening for pouring or insertion of straws. These, like the slitted lids above mentioned, need straws to be supplied, and, moreover, are not sold empty, to be filled with a beverage of choice. Too, when once opened and before any potable is dispensed, they permit sloshing.

SUMMARY OF THE INVENTION

1. Purposes of the Invention

It is an object of the present invention to provide for an open-top potable container a closure lid which will permit a person to drink through it without removing the lid from the container.

It is another object of the invention to provide a lid of the character described which will inhibit sloshing of the potable in the container.

It is another object of the invention to provide a lid of character described which can be nested compactly into another like lid so that a stack of internested lids will occupy no more space than a stack of prior art nested lids not having the unique functions of the new lid.

It is another object of the invention to provide a lid of the character described which, during drinking, allows a person to partially insert the tip of his nose into the container, despite the non-removal of the lid, whereby the container can be handled during drinking in the same manner that it would be if the lid were not present.

It is another object of the invention to provide a lid of the character described which allows the aroma of the beverage, if it has one, to permeate through the lid in the vicinity of the drinker's nose so that the drinker will be accorded the full satisfaction of smell as well as taste during drinking.

It is another object of the invention to provide a lid of the character described which is so constructed as to permit partial insertion of the tip of a person's nose into the container during the drinking and concurrently to allow escape of the aroma of the potable through the lid in the vicinity of the tip of the nose, thus simultaneously affording oral and olefactory satisfaction.

It is another object of the invention to provide a lid of the character described which, preferably, has an overall height approximately the same as the height of a conventional lid.

It is an ancillary object of the invention to provide a lid of the character described which has at least a depressed or depressible area in the top wall thereof which will accomodate the tip of a person's nose who is drinking through said top wall.

It is another ancillary object of the invention to provide a lid of the character described the top wall of which is at approximately the same level with respect to the periphery of the lid as a conventional lid, but which is so constructed that at least an area thereof may easily be deformed so as to lower the same in order to create a depression that serves both to accomodate the tip of a person's nose and to form inclined downwardly extending baffle walls spaced from the periphery of the lid for dampening slosh waves.

It is another object of the invention to provide a lid of the character described having small openings therein, preferably in a limited area which includes a portion adjacent to the periphery of the lid.

It is another object of the invention to provide a lid of the character described in which, if desired, the small openings in the limited area are blocked in the lid as supplied, the blocking being so fashioned as to be selectively rendered inoperable as by the use of a strippable layer or a water-soluble safely ingestible coating.

It is another object of the invention to provide a lid of the character described which, because it does not have to be removed to permit the drinking of beverages having temperatures other than ambient temperature, will keep the beverages warm or cool for longer periods of time.

It is another object of the invention to provide a lid of the character described that can be manufactured at a cost very little more than the manufacturing cost of a conventional lid.

It is another object of the invention to provide a lid of the character described the use of which is apparent simply upon inspection of the lid so that it is not necessary to provide or disseminate instructions as to its operations by even the most obtuse members of the public.

Other objects of the invention in part will be obvious and in part will be pointed out hereinafter.

2. Brief Description of the Invention

The lid of the present invention is conventional in many aspects. For example, it is made of light-weight inexpensive thin-walled material. It preferably is fabricated by a forming operation from flat sheet material. Although the sheet material may be metal foil or wax or resin impregnated paper, the material of choice is a thermoplastic synthetic plastic. Casting, i.e., molding, of a plastic to make a lid presently is too costly; the method that is most desirable in thermoforming, and accordingly is the method which is considered to be the most effective for practicing the present invention. "Thermoforming" as employed herein embraces all methods of making shaped items from a thermoplastic sheet and includes such standard industrial processes as vacuum forming and forming between a pair of dies, the sheet either being heated prior to forming or being heated by heat supplied by the dies themselves. Typical plastics that may be used for the making of the lids of the present invention are polyvinyl chloride, polyvinyl acetate, polyethylene, polypropylene, high impact polystyrene, i.e., a copolymer of butadiene and styrene, polystyrene, polycarbonates, and ABS, an acrylonitrile-butadiene-styrene copolymer. The thickness of the sheet material employed is that which conventionally is used for closure lids, a typical thickness being 0.010 inch. This figure is given only by way of illustration inasmuch as the same may vary within limits employed in the field.

The lid includes a circular top wall, i.e., crown, a peripheral beaded rim and a skirt which depends from the rim. The top wall may be somewhat below the top of the beaded rim as is conventional in the art of closure lids, whereby there is formed on both sides of the beaded rim a pair of approximately parallel annular walls designed to frictionally constrictively grip between them the lip of an open-top beverage container and form a lid lip of which a portion can be engaged by the lips of a drinker in a fashion similar to lip engagement of the rim of a cup. If the container includes an internal annular groove a short distance below the lip, the wall of the lid between the beaded rim and the crown may be provided with a matching outwardly projecting annular rib designed to engage the container groove. Moreover, the outer wall extending downwardly from the beaded rim may be provided with a radially inwardly projecting annular rib to engage the underside of the bead of the rim of the container if the container has such a bead. In summary, the periphery of the lid is provided with means for releasably sealingly engaging the lip of a container so that when once emplaced it will not be readibly accidentally disengaged. All of the foregoing details regarding the construction of the lid are conventional.

Pursuant to the instant invention the top wall, i.e. crown, of the lid embodies a unique construction which renders the lid peculiarly capable of performing the various functions to which reference previously has been made in connection with the Purposes of the Invention. Such construction at a minimum includes the provision of a group of small through-openings in a limited area of the lid extending centrally inwardly from adjacent to the periphery thereof. The sizes of the openings are not critical nor need they all be of the same size. They should be such that liquid can flow through them. In other words, the openings must be larger than of capillary dimensions. By way of example, a desirable practical lower limit for the sizes of the openings, assuming the same to be circular, although the configuration of the openings is not of importance, is about one sixty-fourth of an inch. Nor should the openings be excessively large because, as has been initiated previously, the sizes of the openings should be such as to discourage the flow through the openings of a surge or slosh wave. Again, in a practical sense, a desirable maximum size for the openings, once again assuming circularity, is about one quarter of an inch. The aforesaid limits are only suggested and are not to be considered as limitative.

The arrangement of the openings, i.e. the configurations of the limited area, likewise is not critical but, in general, a suitable arrangement is sectorial, although a segmental area also will provide satisfactory results, despite the fact that it has a disadvantage in connection with the practice of the invention which soon will be mentioned. In other words, a desirable pattern for the limited area in which the small openings are located is one which starts adjacent the periphery of the top wall, e.g., within about one quarter of an inch thereof, and extends toward the center of the top wall. The breadth of the area adjacent the periphery preferably is such as to permit, in conjunction with the total number of openings, a ready flow of beverage through the openings when the container is tilted about a horizontal axis tangential to the periphery of the top wall at the center of the arc defining the outer extremity of the limited area. The breadth of the limited area should not be so great that if a person engages his lips with the periphery of the lid for drinking the area will extend beyond the zone of engagement, because this would permit the beverage to dribble to the sides of such area of engagement with consequential unpleasant effects. The openings are rather close to one another, typically one sixty-fourth to one-quarter of an inch (closer with smaller openings and larger with larger openings), in order to achieve the effect of free flow of the beverage through the top wall during drinking. Desirably the limited area extends far enough toward the center of the lid so that it will include a portion which is beneath the drinker's nostrils, thus enabling the person who is using the lid through which to drink the beverage to enjoy the full aroma and fragrance issuing through such openings.

Although the invention can be practiced in a less than desirable manner if the openings are formed in the top wall of a lid which wall is at a location identical to that of the top wall of a conventional lid, far superior results are achieved where the top wall or at least a part thereof which includes the aforesaid limited area is depressed below the location of a conventional top wall which is to say depressed a substantial distance below the beaded rim. "Substantial" as used herein indicates a distance which is sufficient to permit the tip of the nose of a person to be lowered beneath the highest point of the periphery of the lid without striking the top wall in order to accomodate the person's nose during drinking as the bottom of the container is tilted upwardly in the fashion it usually is during drinking. This best can be appreciated by considering the ability to drink through a lid with a non-depressed top wall which is provided with the openings as indicated. Drinking could be performed with such an arrangement but it would be a somewhat difficult task. The person would have to manage to tilt the container so as to cause the beverage to flow through the openings in the aforesaid limited area without lowering the tip of his nose into the container as he ordinarily would do when drinking from a nonlidded open-top container.

In accordance with a useful feature of the instant invention, this difficulty is avoided by depressing the top wall of the container, at least in the aforesaid limited area, by a "substantial" amount. Once again, by way of example but not by way of limitation, a typical depression is in the order of one-half inch. The entire top wall of the lid can be thus depressed. Depression of the complete top wall is optional but not necessary and, indeed, is not the preferred form of the invention. Better results are achieved when the top wall is depressed in a restricted area, for example, in the aforesaid limited area, although the depression may be either in excess of or less than that area, the depression should be at least large enough to permit the nose to enter easily into the same during drinking.

A depression of such limited area has the further advantage that is provides sidewalls which define the depression. These sidewalls extend downwardly from the top wall of the lid into the container toward the surface of the potable therein. Said sidewalls act as baffles which will tend to inhibit surge movement of the liquid in the container when the container is moved in a fashion which, were the lid not present, creates waves that would overflow the rim. The baffles tend to suppress these surges so that the level of the potable remains more even despite surge-creating forces and therefore the potable will not tend to flow through the openings so rapidly as to spill over the adjacent portion of the periphery of the lid, this despite the fact that the potable will flow readily through the lid for drinking purposes when the container is tilted deliberately during imbibition. It is believed that the action of the baffles to minimize surge waves under the conditions aforesaid is made more effective where the downwardly extending walls defining the nose-receiving depression are angled, good results have been obtained where inclination is between about 45° to about 60° to the plane of the undepressed portion of the top wall of the lid.

Although a lid made as described above is quite satisfactory in operation there is a secondary problem which has no connection whatsoever with the novel functions of the lid. It is that the lid is higher than a conventional lid. A stack of such nested lids is higher than a stack of the same number of nested conventional lids. This leads to higher shipping costs and storage space. Pursuant to a further aspect of the invention the top wall in the most preferred form is so constructed that it is deformable to provide the aforesaid depressed area. The structures which enable a ready deformation to be practiced are varied and therefore will not be summarized in this portion of the patent. However, they will be set forth subsequently.

A further feature of the invention concerns a modification of the new lid to positively prevent accidental liquid penetration of the small openings when a lidded container is carried out. It will be appreciated that in normal use the time when the liquid in the container is most likely to have surge waves created therein is during transport from the place where the container is filled to the place where the beverage is to be consumed. To positively prevent escape of liquid during this transport there can be provided a temporary arrangement for blocking the openings. Thus the lid can be supplied with a strippable imperforate liquid-impermeable panel which covers and thereby blocks the small openings. When it is desired to drink from the container through the lid it only is necessary to strip off this panel. Another arrangement for accomplishing substantially the same purpose in a less expensive but somewhat less satisfactory manner is to apply to the lid over the limited area a film of water-soluble plastic. This will protect against accidental spillage during transport but will permit the beverage to flow through the openings when the container deliberately is tipped and saliva from the mouth of the user contacts the plastic. Typical such plastics are polyvinyl alcohol and carboxymethylcellulose.

The invention accordingly consists in the features of construction combinations of elements and arrangements of parts which will be exemplified in the lids hereinafter described and of which the scope of invention will be indicated in the appended claims.

PREFERRED EMBODIMENTS OF THE INVENTION

Figure 1:
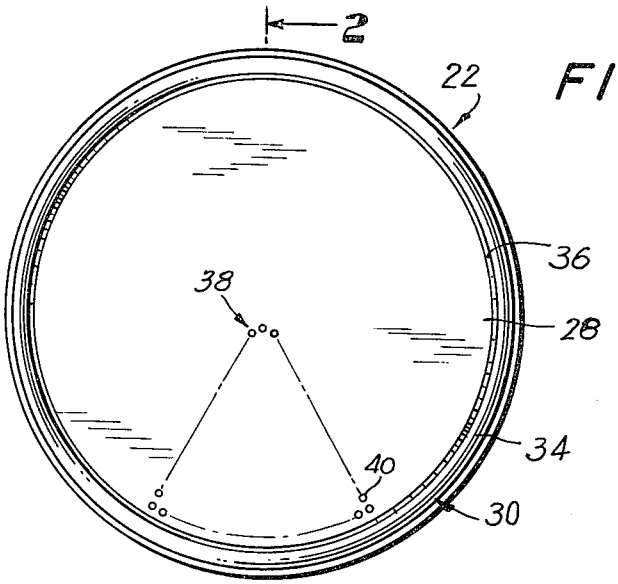
FIG. 1 is a top view of a lid of the present invention on a container, the lid being of the simplest embodiment of the invention that includes a limited perforate area.
Figure 2:
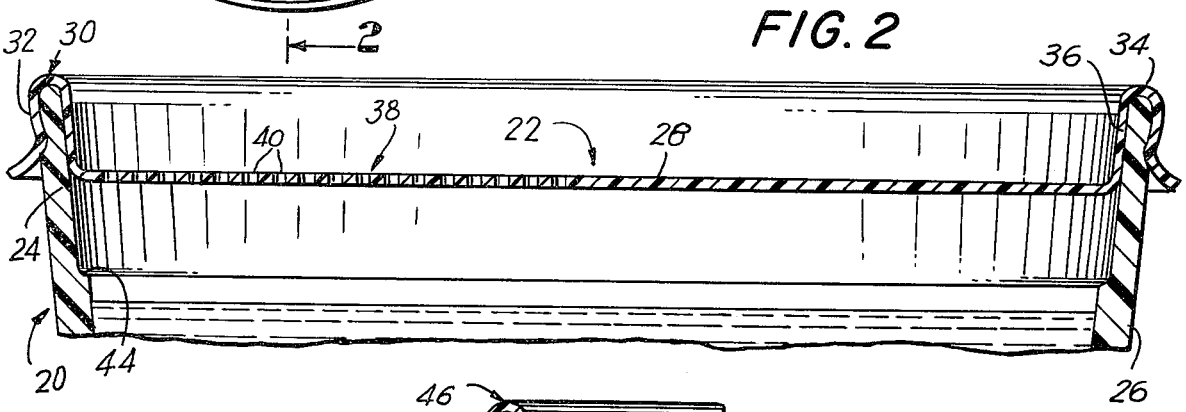
FIG. 2 is a fragmentary sectional view taken substantially along the line 2—2 of FIG. 1.

Referring now in detail to the drawings and, more particularly, to FIGS. 1 and 2, the reference numeral 20 denotes an open top container adapted to have a closure lid 22 detachably sealingly engaged to the lip, i.e. rim, 24 thereof.

The container is of any conventional configuration and construction. Typically, it has a circular open top and downwardly converging side walls 26 so that it is of frusto-conical contour with a smaller closed bottom and a larger open upper end. Containers of the aforesaid type may vary in sundry details according to manufacturing equipment and desired functions, but they all have in common an open top which almost invariably is circular. The containers, may be of any acceptable material, e.g. wax or resin impregnated paper, non-foamed plastic or foamed plastic. The lids of the present invention are designed with peripheral engaging means for releasably sealingly gripping the container lips, such means permissibly varying in detail to cooperate with differently constructed container lips.

The lid 22 is fabricated from any material commonly used for lids. This usually will be a non-foamed plastic, although metal foil, or wax or resin impregnated paper or foamed plastic can be used. The lid must be resilient, at least at its peripheral zone, to permit it to engage the open mouth of the container with a snap fit so that the lid can releasably sealingly engage said mouth to enable it to be emplaced with ease and to resist accidental removal. Indeed, due to the pour-through construction of the lid, it usually will not be desirable to remove the lid when it once has been secured to the container; however, if for some reason the lid is to be deliberately removed, it will not be any more difficult to do so than with a conventional lid having none of the features of the present invention. In other words, the lid includes a conventional peripherally disposed means for releasably sealingly engaging the lip of a container.

More particularly, the lid 22 has a circular top wall 28, i.e. crown, at the periphery of which is provided an integral bead 30 from which a skirt 32 depends. The bead is in the shape of an inverted U the base 34 of which is adapted to seat on the lip, i.e. upper edge, of the rim 24. One of the depending walls of the bead constitutes the skirt 32. The other depending wall 36 of the bead joins the bead to the periphery of the crown. The space between the walls 32, 36 is slightly less than the thickness of the rim 24 and, desirably, the walls converge downwardly toward one another thereby to cause the bead to grip the rim when the lid is snapped on the container to close the open mouth thereof. The lower edge of the skirt flares slightly outwardly to facilitate initiation of interengagement between the lid and the rim. The crown is somewhat below the base of the bead 30, this not being critical.

The lid is made in one piece, as by thermoforming, from a thin flat sheet of a thermoplastic material, typical of which are polyethylene, polypropylene, high impact polystyrene, ABS, polystyrene, polycarbonates, polyvinyl chloride and polyvinyl acetate. A suitable thickness for the sheet material is 0.010 inch.

Were no further features incorporated, the lid 20, as thus far described, would be conventional. Pursuant to the instant invention, however, the lid 20 includes a novel additional structural element that distinguishes said lid and all lids subsequently described herein from the prior art. This new element is shown in and described, in its most rudimentary form, with respect to FIGS. 1 and 2, such form being modified to embody various sophistications, as subsequently will be described in connection with other figures, to render a lid having said element highly practical from manufacturing, storage, shipping and functional points of view.

The new element constitutes the provision of a limited area 38 of small openings 40 each of which extends through the crown 28; the remainder of the crown is imperforate, straw admitting slots, if provided, not being considered to be openings. Conveniently, in any given lid, e.g. the lid 22, all the openings are of the same size. It is within the scope of the invention for the openings to vary in size in the same lid. The openings should be large enough for liquid to flow freely through them when a container with a lid thereon is tilted to raise the surface of the liquid to above that of at least a portion of the area 38. Thus, the openings should be larger than capillary. A suggested minimum size is about one sixty-fourth inch, assuming circularity. On the other hand, the openings should not be too large because enough wall structure must remain and the openings must be small enough to discourage flow through the openings of a surge or slosh wave of potable in the lidded container. A suggested maximum size of opening is about one-fourth inch, assuming circularity. It should be understood that the openings may be of any configuration whatsoever, circularity being mentioned simply because a circular shape is the easiest, least expensive and most desirable for tooling purposes, i.e. for the provision of punches that will be used to cut out the openings. When different sizes of openings are used in a given lid, the larger openings usually will be located adjacent the bead 30 where the potable largely will flow through the lid when imbibed from the container, and the smaller openings will be located further from the bead where vaor from the potable will seep through the lid to allow the escape of aroma which will enhance the pleasure to be derived from drinking the potable.

The area 38 could, in theory, if the only things desirable were the ability to allow through-flow of a potable and penetration of fragrance, cover essentially the entire crown of the lid. But these two desiderata are not the sole controlling parameters. An additional desideratum of this invention is to inhibit flow of slosh waves over the rim of the container. To achieve this, the area 38 should be of limited size whereby the remaining imperforate portion of the crown will completely prevent such overflow therethrough and it only is necessary to proportion the sizes and spacing of the openings to minimize overflow of a slosh wave through the limited area. A shape of area found to yield good results is sectorial, with the widest area adjacent the bead and tapering to its narrowest width adjacent the center of the lid. The widest area should be close to the bead, for example, within about one-fourth inch from the bead. The breadth of the area at this zone best is such that an average person drinking from the container through the lid would have his lips fully span said breadth in order that liquid will not dribble to the sides of his mouth. A typical breadth is about 2 inches. This dimension is not crucial since if there should be a tendency for liquid to dribble past the sides of a person's mouth he would not tilt the container far enough for this to continue.

The center-to-center spacing of the openings is selected to permit free flow of the potable during drinking and yet to inhibit sloshing. The suggested spacing between the openings is from about one sixty-fourth to about one-fourth inch, the closer spacing being used for smaller openings and the larger for larger openings.

The limited area extends inwardly toward or beyond the center of the lid a distance sufficient to permit the aroma of the potable to pass through the area toward the drinker's nose. About 1 inch or somewhat less suffices for this purpose.

Figure 3:
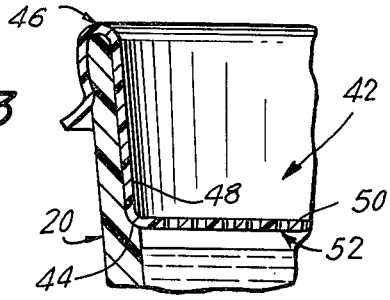
FIG. 3 is a view similar to FIG. 2, but more fragmentary, and showing a modified lid similar to that of FIG. 1, but with a crown that is lower and seats on an internal shoulder on the container.

In FIG. 3 there is illustrated a lid 42 which differs from the lid 22 solely in its mode of engagement with the container 20. As shown in FIG. 2, but not previously described, the container 20 has an internal annular seat 44. The lid 42 has a bead 46 with an inner depending wall 48 corresponding to but deeper than the depending wall 36 of the lid 22, thereby lowering the corner between the crown 50 and said wall 36. The depth of the wall 36 is such that the crown rests on the seat 44 providing a better seal between the lid 42 and the container 20 than between the lid 22 and the container. The arrangement of FIG. 3 has the further advantage that, because the crown 50 is lower than the crown 28, the slosh inhibiting action occurs sooner (assuming the same height of liquid) and is more effective. Said crown 50 has a limited perforated area 52 which is the same as the area 38, serves the identical function and is of the same construction.

Figure 4:
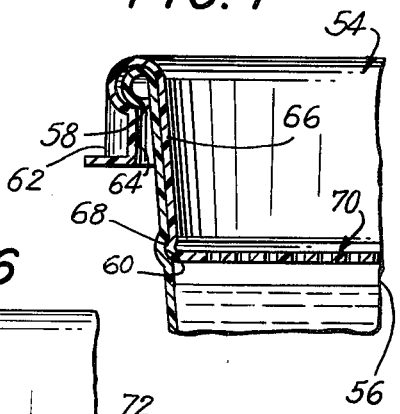
FIG. 4 is a view similar to FIG. 3 of another modification of the lid which is provided with a radially outwardly protruding annular rib that engages a matching annular groove in the container, the lid having a limited perforate area.

In FIG. 4 another lid 54 is illustrated to depict a different variation of the present invention. The lid is shown in conjunction with a container 56 having a configuration somewhat different from that of the container 20. The container 20 is of a shape commonly used when the container is made of a foamed plastic. The container 56 is of a shape commonly used when the container is made from sheet material, e.g. sheet plastic or a wax or resin impregnated paper. In such latter containers the lip often is formed with a rolled edge 58 as well as with an internal annular groove 60 a short distance below the lip. The skirt 62 has several internally extending ribs 64 shaped to extend beneath and frictionally engage the underside of the rolled edge 58 when the lid is coupled to the container. Moreover, the inner depending wall 66 of the lid is provided with an external annular ridge 68 that matches and is designed to snugly engage the groove 60 so as to more firmly interengage the lid to the container. The lid 54 includes a limited perforated area 70 which is the same as the area 38, serves the identical function and is of the same construction.

The lids described with respect to FIGS. 1–4 perform the three basic functions of the present invention, to wit: through-the-lid drinkability, escape through the lid of fragrance under and to the drinker's nostrils and slosh inhibition. However, there is, in drinking from such a lidded container, a certain awkwardness that arises from interference between a drinker's nose and the crown of the lid. It is habitual for a person who drinks from an open top container to raise the bottom of the container, and tilt the same, while only slightly tilting his head, and hence his nose, rearwardly. Therefore, when thus drinking, the tip of the nose will enter the container for a short distance, e.g. about one-half to about three-fourths inch. In the lids thus far described, such relative movement of the tip of the nose and the crown of the lid is impeded. However, the foregoing difficulty is avoided by utilization of any of the lid structures illustrated in FIGS. 5 through 16.

Figure 5:
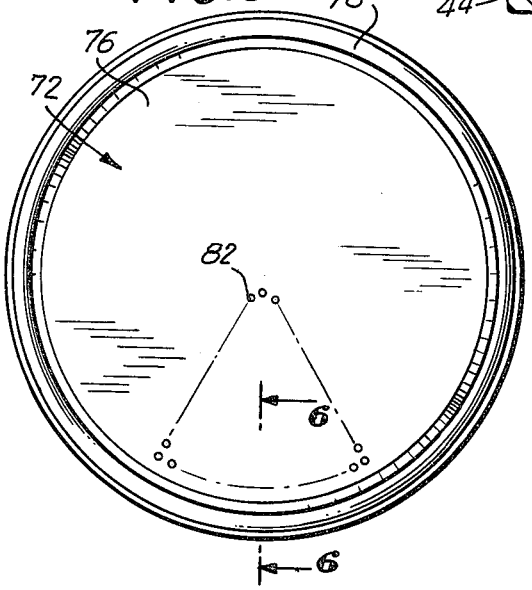
FIG. 5 is a top view of a lid on a container, the lid being modified to include a top wall, all of which is depressed to permit accommodation of the tip of a person's nose during drinking; the lid has the characteristic limited perforate area.
Figure 6:
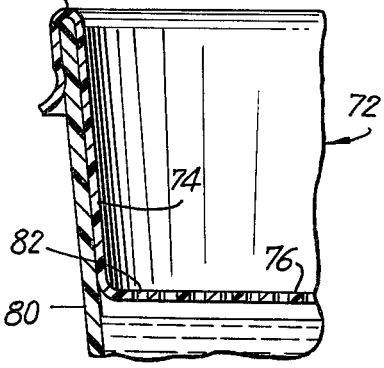
FIG. 6 is an enlarged fragmentary sectional view taken substantially along the line 6—6 of FIG. 5.

Referring to FIGS. 5 and 6, a lid 72 is shown which differs from those previously described in an increase in length of the depending inner wall 74 with a corresponding lowering of the crown 76 with respect to the bead 78. An excellent depth for the crown is about one-half to about three-fourths inch which allows the container 80 to be manipulated naturally, as described above, during drinking without having the tip of the drinker's nose strike the crown. The crown has a limited perforated area 82 which is the same as the area 38, serves the identical function and is of the same construction. It will be seen that the entire crown is depressed to the same height.

Figure 7:
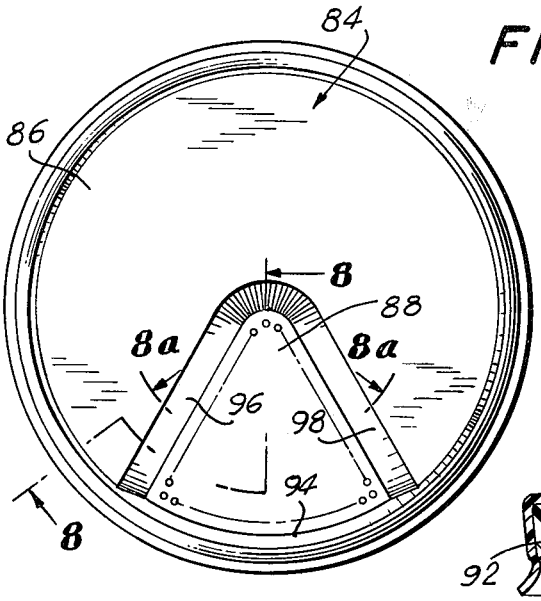
FIG. 7 is a top view of a lid on a container, the lid being modified to include a top wall having a limited perforate area thereof depressed to accommodate the tip of a person's nose during drinking and also to provide inclined baffles for minimizing the heights of slosh waves.
Figure 8:
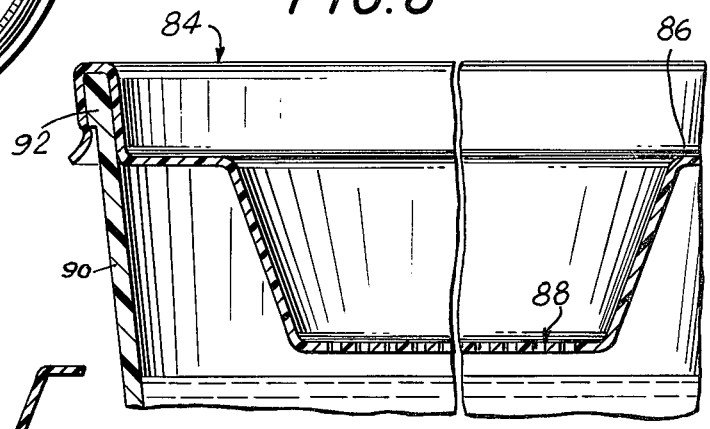
FIGS. 8 and 8*a* are enlarged fragmentary sectional views taken substantially along the lines 8—8 and 8*a*—8*a*, respectively, of FIG. 7.
Figure 8A:
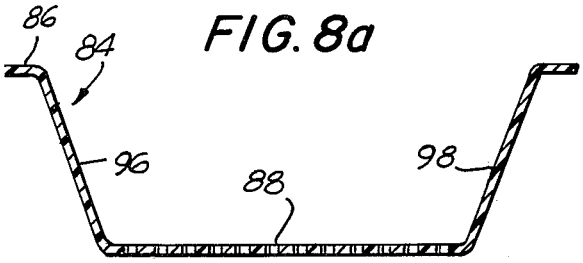

In FIGS. 7, 8 and 8*a* another lid 84 is shown which is much like the lid 72 in that the crown 86 is depressed for admission of the tip of a nose during drinking, but unlike the lid 72, the crown is depressed for less than its entire area, in particular, for an area coextensive with or somewhat larger than the limited perforated area 88. Except for the limited depressed perforated area 88, the lid 84 is the same as the lids 22, 42, 54 and 72. There is a further minor variation in that the peripheral zone of the lid is shaped to accommodate a container 90 having an integral molded bulging edge 92 at the lip thereof.

The depressed limited perforated area 88 is connected to the higher level remaining portion of the crown by walls 94, 96, 98. The wall 94 is adjacent the side wall of the container. The walls 96, 98 join the radial edges of the sectional area 88 to the remainder of the crown.

In addition to enabling the area 88 to be depressed for the purpose mentioned, the walls 96, 98 serve a further purpose; they act as baffles to dampen slosh waves. These walls extend downwardly toward the surface of potable in the container so that they interfere with free movement of slosh waves across the potable toward the depressed perforated limited area and, in so doing, lower the level of the wave that enters the depressed area. This dampening of slosh waves is enhanced by inclination of the side walls 96, 98 upwardly and outwardly from the area 88 since waves striking these walls tend to rebound at a downward angle so as to lessen the energy of the slosh waves impinging on said walls. The side walls 96, 98 preferably are imperforate to maximize the aforesaid effect. However, the wall 94 may be perforate or imperforate. The placement of perforations in the wall 94 assists the ease with which a drinker can imbibe through the lid 84.

In the various forms of lid thus far described, the through-openings in the limited perforated areas were present in the lids as manufactured, as sold and as applied to containers. Therefore, if the lidded containers were handled very roughly or if they were dropped, liquid would flow through the openings although no such flow was intended. In accordance with another form of the invention, such inadvertent flow is prevented, or, at least, delayed until the container is used in the manner for which it was intended. Such form of the invention will be described with reference to FIGS. 9–12.

Figure 9:
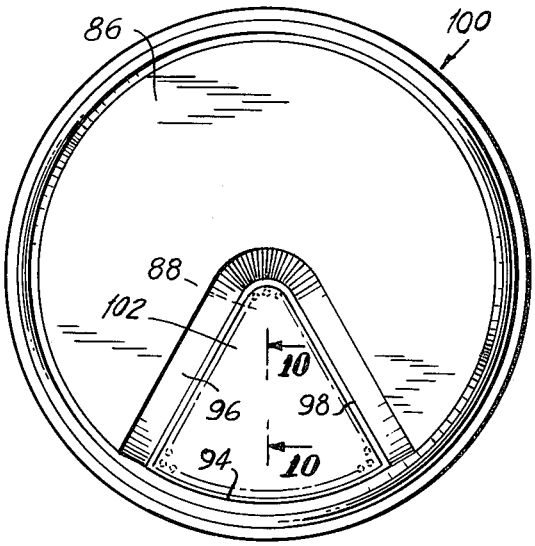
FIG. 9 is a top view of a lid on a container, the lid having a depressed limited perforate area which is covered with a water-soluble coating.
Figure 10:
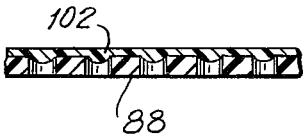
FIG. 10 is a highly enlarged fragmentary view taken substantially along the line 10—10 of FIG. 9.

In FIGS. 9 and 10 a lid 100 is seen which is identical to the lid 84 and has its various parts denoted by the same reference numerals. The lid 100 differs from the lid 84 solely in that means is included to prevent flow of liquid through the openings in the area 88 regardless of the position of the container or its manner of handling. Said means constitutes a solid coating 102, i.e. a film, of a water-soluble synthetic plastic. The plastic blocks the openings in the area 88 so long as the plastic has not dissolved. The plastic does not dissolve immediately upon contact with water or a liquid containing a substantial percentage of water, e.g. coffee, tea, milk, carbonated or non-carbonated drinks, hot chocolate, saliva, etc. The time for dissolution is a matter of a few seconds or more, depending upon the temperature of the liquid and the thickness of the film. A satisfactory film thickness is about 0.003 inch. This permits the film to fill the openings for the short time that a water-based liquid may inadvertently touch the limited area, but allows the film to dissolve quickly when it is desired to drink the contents of the container through the lid. Typical suitable plastics are polyvinyl alcohol and carboxymethyl cellulose. They are applied conventionally as by spraying, brushing or dipping with or in a liquid containing the plastic dissolved in a a volatile carrier and permitting the carrier to evaporate.

Figure 11:
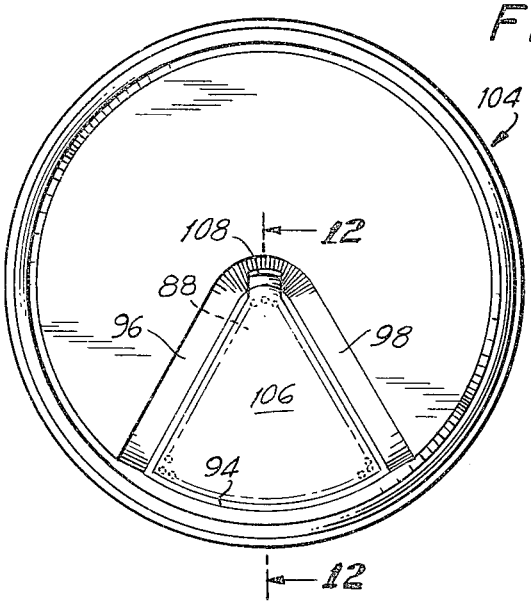
FIG. 11 is a top view of a lid on a container, the lid having a depressed limited perforate area which is covered with a strippable water-impermeable, water-insoluble layer.
Figure 12:
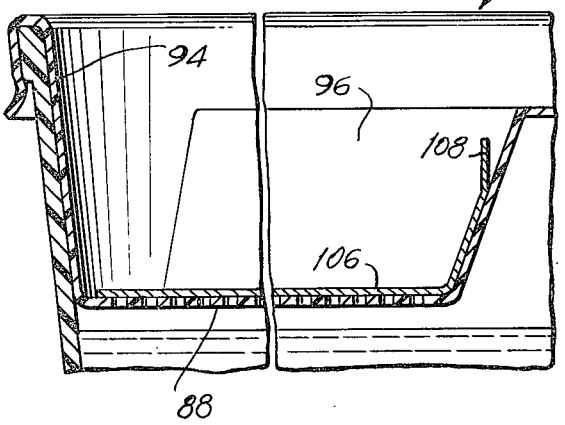
FIG. 12 is an enlarged fragmentary view taken substantially along the line 12—12 of FIG. 11.

In FIGS. 11 and 12 another form of lid 104 is shown which accomplishes the same additional function as the lid 100 but in a different manner. Like the lid 100, the lid 104 is identical to the lid 84 and has its various parts denoted by the same reference numerals. The sole difference from the lid 84 resides in the provision of a flexible panel 106 which overlies the limited perforated area 88. The panel is made of a water-impervious, water-inert sheet that overlies the area 88, is adhered thereto and is strippable therefrom. The sheet may be made of a wax or resin impregnated paper, metal foil or a synthetic plastic. The undersurface of the panel is coated with a water-inert pressure-sensitive adhesive, to wit, a dry, tacky adhesive that forms a good bond with the panel and a weaker bond with the area 88. The panel includes a tab 108 that is free of adhesive. So long as the panel is in place, no liquid can penetrate the openings in the perforated area 88. When liquid is to be drunk through the lid, the user grasps the tab 108 and pulls the panel off, exposing the area 88 to allow use of the lid in the manner above described. If desired, the panel can be reapplied after partial withdrawal of liquid from the container.

It will be appreciated that the provision of a prefabricated entirely depressed crown or a prefabricated crown with a depression over only the limited perforated area resulting in a lid higher than a conventional lid with a limited perforated area, may make compact stacking more difficult to accomplish and inevitably will result in a higher stack for the same number of lids. To attain all the advantages of the present invention and yet minimize the aforesaid problems, a still more sophisticated version of lids is provided, the same being shown in FIGS. 13–16, which constitute lids of normal height for manufacture, stacking, storage, shipment, sale and application to containers, to depress the limited perforated areas a substantial amount that is enough to accommodate the tip of a person's nose during drinking. In other words, such lids have a depressible perforated area, which is to say, a perforated area that, as made, handled, sold and applied to a container, is in or slightly below the plane of the periphery of the lid but which readily can be manipulated to shift the same into a desired depressed position.

Figure 13:
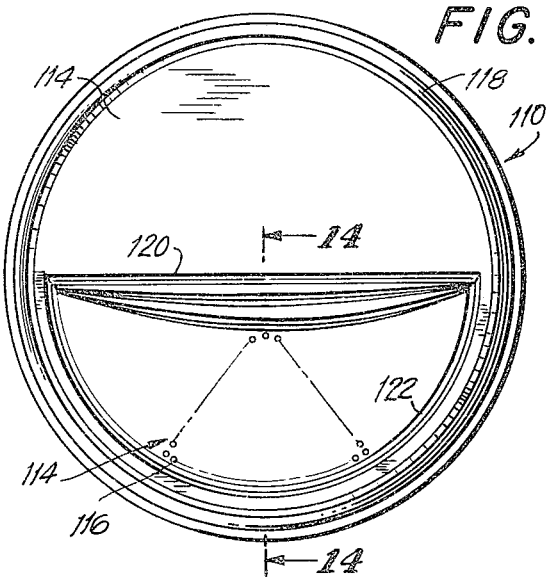
FIG. 13 is a top view of a lid on a container, the lid having a depressible semi-circular portion including the characteristic limited perforate area.
Figure 14:
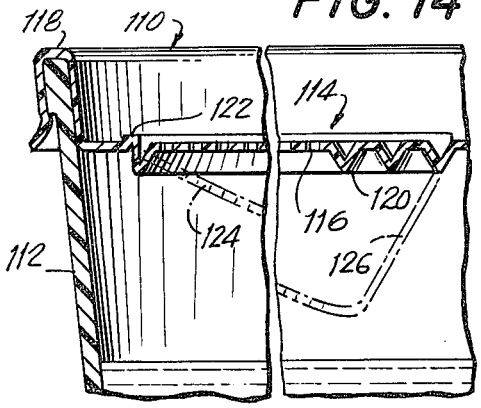
FIG. 14 is an enlarged fragmentary view taken substantially along the line 14—14 of FIG. 13, the solid lines illustrating the pre-depressed configuration and the dot-and-dash lines illustrating the post-depressed configuration.

Turning to FIGS. 13 and 14, a lid 110 is disclosed that embodies the aforesaid sophisticated version. The lid is coupled to a container 112 with a conventional peripheral coupling means such as described previously. Said lid has a crown 114 slightly below the rim of the open mouth of the container, the height of the crown being such that it would be in the path of the tip of the nose of a drinker who tried to drink in a normal fashion from the container with liquid flowing into his mouth through a limited perforated area in the lid 110. The unique construction of the crown permits this area to be depressed manually so as to transform the crown into a shape that will accommodate the tip of the nose during drinking.

Said crown has a limited perforated area 116 of wedge shape extending from adjacent the bead 118 of the lid to adjacent the center of the lid. The crown is provided during its thermoformation, as with the aid of dies, with a series of pleats, i.e. flutes 210. The flutes are close together and approximately parallel to each other and to a diameter perpendicular to the radial median line of the area 116. An exemplificative arrangement is shown with one pleat at such diameter and the remaining pleats (two additional pleats are illustrated although more may be employed) on the area side of the diametral pleat. The additional pleats are slightly bowed toward the area. The material of the crown is flexible whereby, if manual pressure is applied to the area 116 or to the crown in the vicinity of the area, said area and the adjacent part of the crown on the same side of the pleats will be depressed and will remain depressed after the pressure is released. An additional peripheral pleat 122 may be included, the same being of semi-circular plan contour and located with its ends at the ends of the diametral pleat and its arch next to the bead 118, crossing the wide portion of the wedge shaped area 116. The pleat 122 likewise expands when the above mentioned manual pressure is applied and remains extended when the pressure is released. The depths of the various pleats are sufficient so that when they are expanded the semi-circular portion of the crown including the area 116 assumes a trough-shaped configuration as shown by the dot-and-dash line position illustrated in FIG. 14. The deepest portion of the trough is near the center of the lid and is sufficiently deep to accommodate the tip of a drinker's nose. The configuration of the crown before application of manual pressure is indicated by the solid lines in FIG. 14. Attention is called to the fact that the trough includes an inclined wall 124 sloping centerward from the bead 118 and an almost vertical wall 126 extending downwardly across about the center of the lid. Both of these downwardly extending walls function as baffles to dampen slosh waves. The area 116 is in the moderately inclined wall 124. Excellent materials for use in lids formed with pleats which are to be expanded in the aforesaid manner are polyethylene and polypropylene.

It will be appreciated that the depth of the lid 110 prior to manual depression is about that of the lid 22 or the lid 42 so that lids 110 can be stacked to about the same height as conventional lids. The pleats 120 and 122 of juxtaposed lids interfit nicely so as not to noticeably increase the height of the stack.

It is to be understood that once the pleats are expanded there is neither intent nor need to have them restored to their contracted condition inasmuch as the lid 110 is disposable along with the container 112 after the potable in the container has been consumed.

Figure 15:
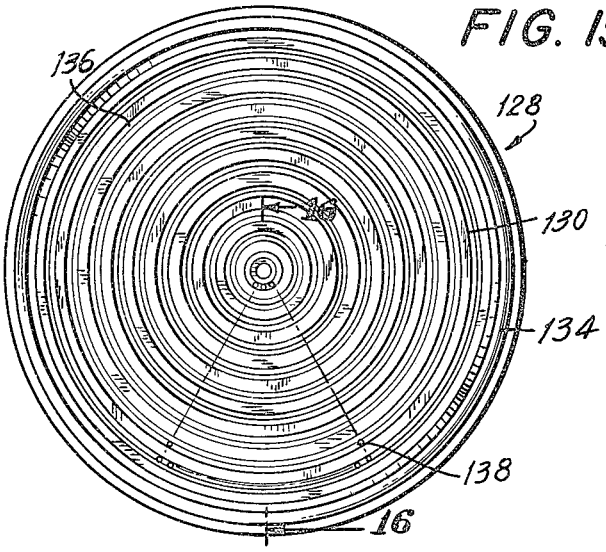
FIG. 15 is a view similar to FIG. 13 of a lid with substantially the entire top wall depressible into a conical configuration.
Figure 16:
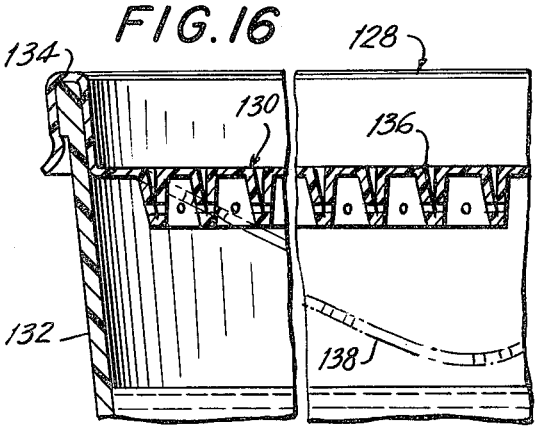
FIG. 16 is an enlarged fragmentary view taken substantially along the line 16—16 of FIG. 15, the solid and dot-and-dash lines having the same connotations as in FIG. 14.

In FIGS. 15 and 16 there is shown a lid 128 embodying a variant of the lid 110 and which, like the lid 110, is depressible upon the application of manual pressure to be transformed from a horizontal crown position as shown in solid lines in FIG. 16 to a downwardly conical crown position as shown in dot-and-dash lines in the same figure. The lid 128 has a crown 130 which, as sold and coupled to a container 132, is essentially horizontal and slightly below the level of the bead 134 of said lid.

The crown is formed to include several concentric circular pleats 136, i.e. flutes. The flutes may be close together, as depicted, or somewhat spaced. Their mutal spacing and the depths of the pleats are such that upon the application of pressure the crown will assume a conical shape that is deep enough at its center to accommodate the tip of a person's nose drinking from the container through the lid. The crown is formed with a limited perforated area 138 which is the same as the areas previously detailed, serves the identical function and is of the same construction; that is to say, liquid will flow through the area into a consumer's mouth for drinking and the inclined walls of the conical depression, both the perforate and imperforate portions thereof, will act as baffles to dampen slosh waves. The openings are essentially blocked in the non-depressed condition of the crown.

It thus will be seen that there are provided devices which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. A closure lid for capping the open top of a potable container, said lid having peripheral means for releasably sealingly engaging the lip of the container, a crown, and means providing a limited area in said crown having a group of small openings therein at least adjacent the periphery of the crown through which the potable in the container may be drunk through the lid, said crown being imperforate except at said area, the sizes and spacings of said openings inhibiting slosh waves in the potable, said lid having flutes which are expandable downwardly to open up upon application of manual pressure to the crown in the vicinity of the limited area whereby to form a depression to accommodate the nose of a person drinking the potable from the container through the lid, the side walls of the depression acting as baffles to further minimize slosh waves in the potable.

2. A lid as set forth in claim 1 wherein the flutes are parallel to a diameter of the crown.

3. A lid as set forth in claim 2 wherein the flutes are beyond the limited area.

4. A lid as set forth in claim 2 wherein the depression formed by pressing on the depressible area is in the shape of a trough.

5. A lid as set forth in claim 1 wherein the flutes are in the configuration of concentric circles.

6. A lid as set forth in claim 5 wherein the depression formed by pressing on the depressible area is conical.

7. A lid as set forth in claim 5 wherein the flutes block the openings.

* * * * *